US008757759B2

(12) United States Patent
Yamashita

(10) Patent No.: US 8,757,759 B2
(45) Date of Patent: Jun. 24, 2014

(54) TEMPERATURE DETECTING APPARATUS

(75) Inventor: Toru Yamashita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 190 days.

(21) Appl. No.: 13/362,613

(22) Filed: Jan. 31, 2012

(65) Prior Publication Data

US 2012/0249654 A1 Oct. 4, 2012

(30) Foreign Application Priority Data

Mar. 30, 2011 (JP) ..... 2011-074990

(51) Int. Cl.
*B41J 29/38* (2006.01)

(52) U.S. Cl.
USPC ..... 347/17

(58) Field of Classification Search
USPC ..... 347/17
See application file for complete search history.

(56) References Cited

U.S. PATENT DOCUMENTS

| | | | | |
|---|---|---|---|---|
| 2008/0174629 | A1 | 7/2008 | Suzuki | |
| 2008/0211851 | A1 * | 9/2008 | Murashima | 347/17 |
| 2009/0110028 | A1 * | 4/2009 | Goh et al. | 374/185 |
| 2009/0206912 | A1 | 8/2009 | Igarashi | |

FOREIGN PATENT DOCUMENTS

| | | | |
|---|---|---|---|
| JP | 2008-170419 | A | 7/2008 |
| JP | 2008-170420 | A | 7/2008 |
| JP | 2009-109498 | A | 5/2009 |
| JP | 2009-192507 | A | 8/2009 |

OTHER PUBLICATIONS

Japan Patent Office, Notification of Reason for Refusal for Japanese Patent Application No. 2011-074990 (counterpart Japanese patent application), mailed Apr. 2, 2013.

* cited by examiner

*Primary Examiner* — Manish S Shah
*Assistant Examiner* — Yaovi Ameh
(74) *Attorney, Agent, or Firm* — Baker Botts L.L.P.

(57) ABSTRACT

A temperature detecting apparatus includes: a temperature sensor having an element whose resistance value changes depending on temperature and detecting temperature based on a voltage value obtained by supply of a supply current to the element from a power source and outputting an output voltage depending on the voltage value; a change-instructing-signal output portion connected to the temperature sensor and outputting a change instructing signal for changing the supply current based on the output voltage outputted from the temperature sensor; and a current-value change portion disposed between the power source and the element, connected to the change-instructing-signal output portion, and changing a current value of the supply current to be supplied to the element when having received the change instructing signal.

10 Claims, 15 Drawing Sheets

TEMPERATURE DETECTING APPARATUS

CROSS REFERENCE TO RELATED APPLICATION

The present application claims priority from Japanese Patent Application No. 2011-074990, which was filed on Mar. 30, 2011, the disclosure of which is herein incorporated by reference in its entirety.

BACKGROUND OF THE INVENTION

1. Field of the Invention

The present invention relates to a temperature detecting apparatus used for an electronic device and so forth.

2. Discussion of Related Art

An electronic device having a control means for controlling various operations has a heat generating portion during the operation (hereinafter, it is referred to as a detected object), and, in order to prevent the detected object from thermal destruction, there is generally known a temperature detecting apparatus which detects temperature of the detected object. As an example of the electronic device having the temperature detecting apparatus, there is known an inkjet recording apparatus in which a recording head that ejects ink through a plurality of nozzles is controlled by a control means via a driver IC producing a drive signal for driving the recording head, and in which, in order to prevent the driver IC from thermal destruction, a temperature detecting portion is disposed in the driver IC and a print operation by the recording head is controlled based on the detected temperature of the driver IC.

The temperature detecting portion (a temperature sensor) disposed in the above-described driver IC has an element (e.g., diode or transistor) whose resistance value changes depending on temperature, detects a temperature based on a voltage value obtained by supply of a supply current from a power source to the element, and outputs a output voltage based on the detected temperature. The print operation is controlled by the control means (ASIC: Application Specific Integrated Circuit) based on the output voltage (depending on the temperature).

SUMMARY OF THE INVENTION

On the other hand, recently, in order to reduce a size and a cost of a semiconductor product, a range of the voltage value that can be dealt with in the control means (ASIC) controlling the driver IC is decreased. In other words, as shown in FIG. 16A, a temperature within a low-temperature range lower than a temperature T1 cannot be detected, similarly to a high-temperature range.

Therefore, it is considered that, as shown in FIG. 16B, an output voltage that is a maximum value of analog-digital conversion (AD-MAX) is changed to a maximum value within a temperature range which is possible to be detected, so that the temperature within the temperature range to be conventionally detected can be detected.

However, even if the temperature detection for a temperature range similar to the conventional technique can be performed as mentioned above, in a case where the temperature range of 0° C. to 100° C. is detected by the temperature detecting portion, for example, the range of the output voltage in the temperature detecting portion is limited to the range of 2.1 V to 0 V from the conventional range of 3.3 V to 0 V. In the conventional technique, in a case where the output voltage is at intervals of 0.3 V (fixed), in the range of 3.3 V to 0 V, the output voltage is changed by 0.3 V with a change in temperature of 10° C. such that 10 points of the temperatures can be detected, but in the narrowed range of 2.1 V to 0 V, only 7 points of the temperatures can be detected. Further, as shown in FIG. 16B, in a case where the detected temperature is within the low-temperature range lower than the temperature T1, the output voltage is hardly changed relative to the change in temperature, so that the accuracy of the temperature detection in the low temperature range is much inferior to that in the high-temperature range. In a case where the accuracy of the temperature detection within the low temperature range is necessary, the temperature detecting portion cannot be used.

It is therefore an object of the present invention to provide a temperature detecting apparatus to change an amount of change in output voltage relative to an amount of change in temperature depending on a detected object or an intended purpose (use) by changing a current value of a supply current to be supplied to an element (for example, diode or transistor) of a temperature sensor from a power source.

In order to achieve the above-mentioned object, according to the present invention, there is provided a temperature detecting apparatus comprising: a temperature sensor having an element whose resistance value changes depending on temperature and configured to detect temperature based on a voltage value obtained by supply of a supply current to the element from a power source and to output an output voltage depending on the voltage value; a change-instructing-signal output portion connected to the temperature sensor and configured to output a change instructing signal for changing the supply current based on the output voltage outputted from the temperature sensor; and a current-value change portion disposed between the power source and the element, connected to the change-instructing-signal output portion, and configured to change a current value of the supply current to be supplied to the element, when the current-value change portion has received the change instructing signal from the change-instructing-signal output portion.

BRIEF DESCRIPTION OF THE DRAWINGS

The above and optional objects, features, and advantages of the present invention will be better understood by reading the following detailed description of the embodiments of the invention when considered in conjunction with the accompanying drawings, in which.

DETAILED DESCRIPTION OF THE EMBODIMENTS

Figure 1:
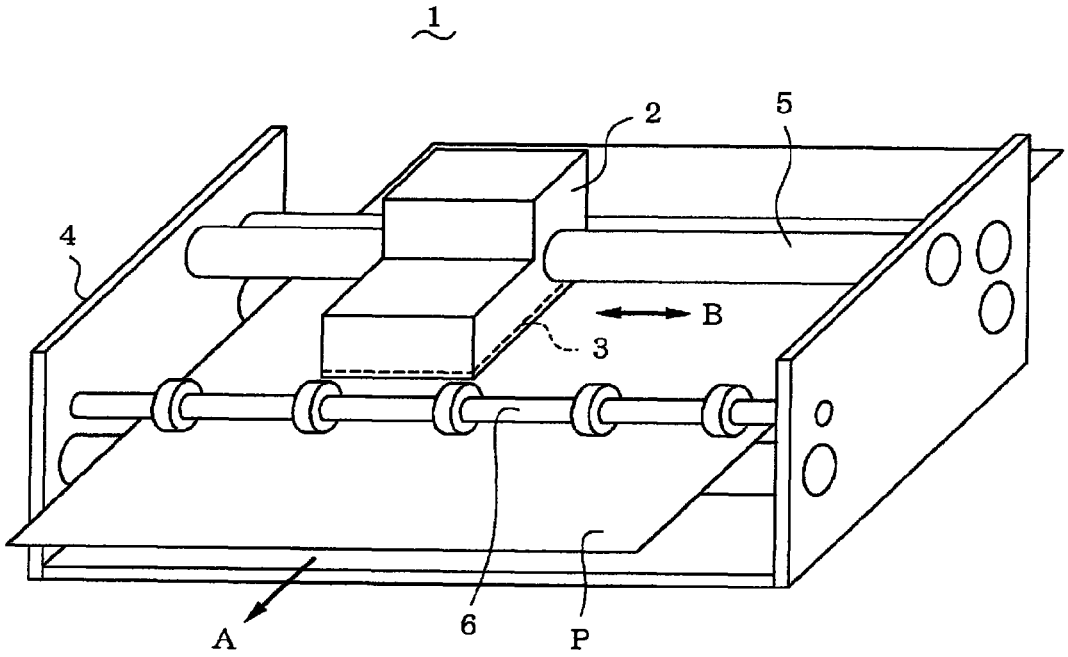
FIG. 1 is a structural view schematically showing an inkjet recording apparatus in which a temperature detecting apparatus, to which the present invention is applied, is utilized.

Hereinafter, there will be described embodiments of the present invention with reference to the drawings. As shown in FIG. 1, in an inkjet recording apparatus 1, an inkjet head 3 for printing a print sheet P is disposed on a lower surface of a carriage 2 on which a plurality of ink cartridges (not shown) are mounted. The carriage 2 is supported by a carriage shaft 5 and a guide plate (not shown) which are disposed inside a frame 4 and is reciprocateable in a direction B perpendicular to a feed direction A of the print sheet P. The print sheet P fed from a sheet supply portion (not shown) in the feed direction A is conveyed between a platen roller/a plurality of platen rollers (not shown) and the inkjet head 3 and is printed in a certain form by ink ejected from the inkjet head 3 toward the print sheet P, and then discharged by a sheet-discharge roller 6.

Figure 2:
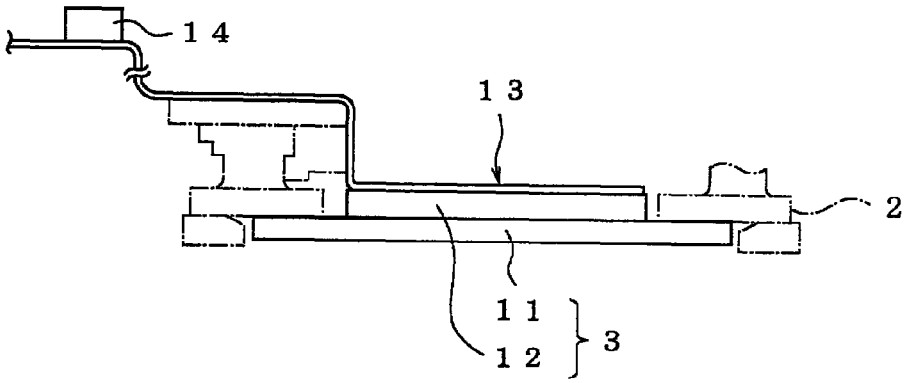
FIG. 2 is an illustrative view showing relations among a cavity unit, a piezoelectric actuator and a flexible wiring board, which constitute an inkjet head of the inkjet recording apparatus.

Further, as shown in FIG. 2, the inkjet head 3 includes a cavity unit 11 and a piezoelectric actuator 12 in order from a bottom, and a flexible wiring board 13 supplying a drive signal is disposed on an upper surface of the piezoelectric actuator 12. A driver IC 14 supplying a drive signal is electrically connected to connection terminals of respective electrodes of the piezoelectric actuator 12 via a signal line (wire) of the flexible wiring board 13. Through the driver IC 14 and the flexible wiring board 13, a drive voltage is applied to the electrodes of the piezoelectric actuator 12 for an ink ejection.

Figure 3:
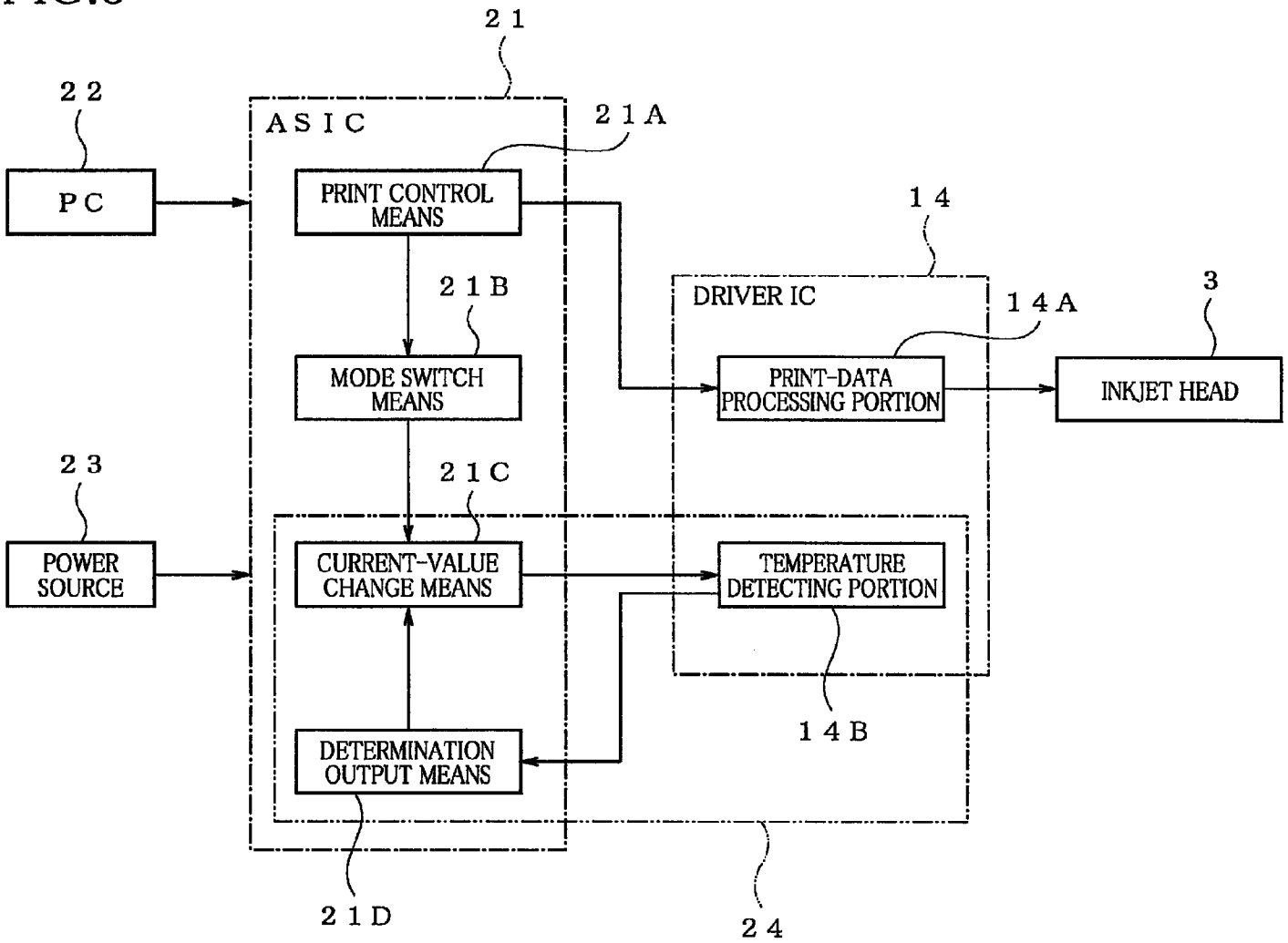
FIG. 3 is a block diagram showing a control system of the inkjet recording apparatus.

As shown in FIG. 3, the driver IC 14 includes a print-data processing portion 14A which drives and controls the inkjet head 3 and a temperature detecting portion (a temperature sensor) 14B which detects a temperature of the driver IC 14. A control means (ASIC) 21 includes a print control means 21A, a mode switch means 21B, a current-value change means 21C, and a determination output means 21D (including a connection switch 21D*a*, a comparator 21D*b* and a reference-voltage generating portion 21D*c*). Print data from a personal computer 22 are inputted to the control means 21 and a power source 23 is connected thereto so as to transmit a drive voltage to the inkjet head 3. The current from the power source 23 is supplied to the temperature detecting portion 14B. The temperature detecting portion 14B, the current-value change means 21C and the determination output means 21D constitute a temperature detecting apparatus.

Figure 4:
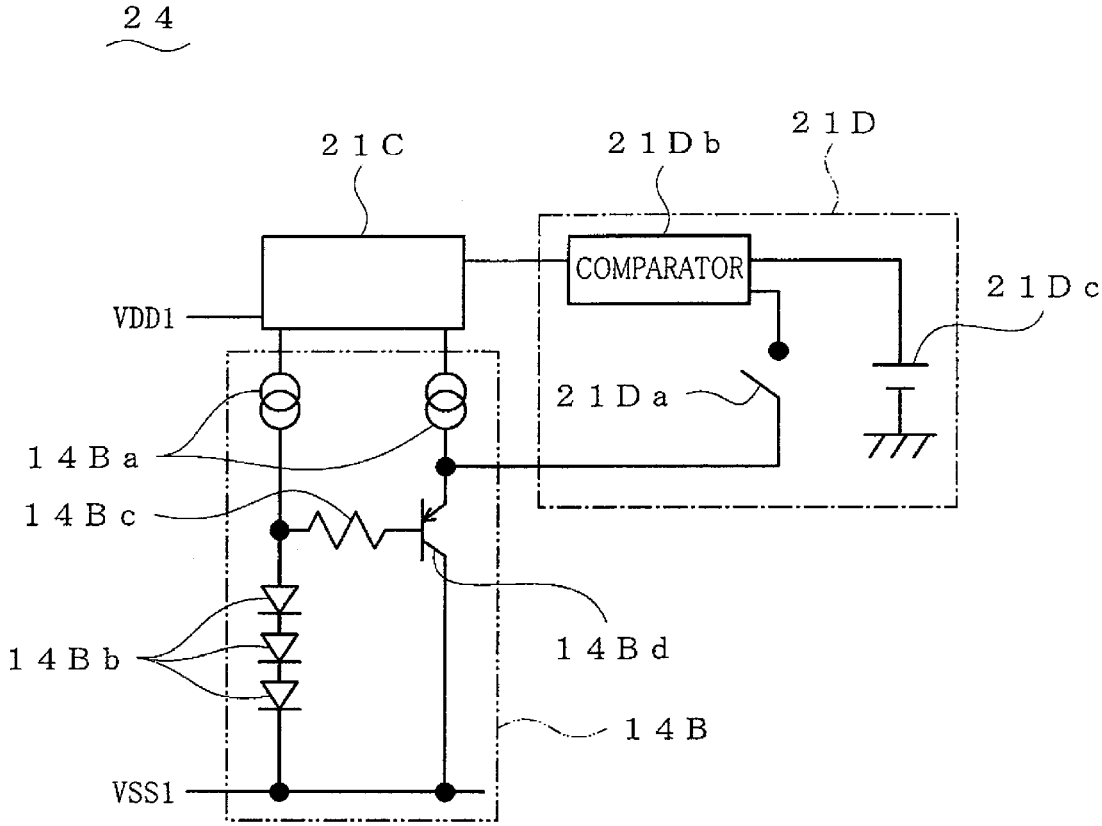
FIG. 4 is an illustrative view showing relations among a temperature sensor, a current-value change means and a determination output means.

As shown in FIG. 4, the temperature detecting portion 14B includes a plurality of transformers 14B*a*, 14B*a*, a plurality of diodes 14B*b*, 14B*b*, 14B*b* arranged in series as elements whose resistance value changes depending on temperature, a resistor 14B*c*, and a transistor 14B*d*. In the temperature detecting portion 14B, the transformers 14B*a*, 14B*a* on an input side are connected to the power source 23 via the current-value change means 21C, and an emitter of the transistor 14B*d* on an output side is connected to the determination output means 21D (the comparator 21D*b*). The temperature detecting portion 14B detects the temperature based on the voltage value obtained by a supply current from the power source 23 via the current-value change means 21C of the control means 21 and based on the detected temperature, outputs an output voltage V which has a certain relation with the temperature.

In the determination output means 21D, the output voltage V from the temperature detecting portion 14B is inputted to the comparator 21D*b* via the connection switch 21D*a* and in the comparator 21D*b* the output voltage V is compared with a reference voltage V1 generated by the reference-voltage generating portion 21D*c*, and in a case where the output voltage V is equal to or greater than the reference voltage V1, a current-value change signal is outputted to the current-value change means 21C.

The print control means 21A transmits the print data from the personal computer 22 to the print-data processing portion 14A and controls a print operated by the ink ejection through the inkjet head 3.

The mode switch means 21B has a plurality of print modes that are different in print duty ratio (a first print mode having a high print duty ratio and a second print mode having a low print duty ratio lower than the first print mode), and determines whether the print mode is changed. In a case of the first print mode, the mode switch means 21B turns on the connection switch 21D*a* of the determination output means 21D such that the temperature detecting portion 14B is connected to the determination output means 21D. On the other hand, in a case of the second print mode, the mode switch means 21B turns off the connection switch 21D*a* such that the temperature detecting portion 14B is not connected to the determination output means 21D. The determination of the print duty ratio, i.e., the determination whether the first print mode (e.g., a photo print mode) or the second print mode (e.g., a draft mode), is performed based on, e.g., an amount of memory of the print data transmitted from the personal computer 22. The print duty ratio can be considered to be a ratio of a period of time (an actual ink ejection period) in which ink is actually ejected from the inkjet head 3 with respect to a period of time (a print operation period) from a start of the print operation to an end thereof, e.g., in a case where the inkjet recording apparatus 1 performs the print operation based on a print command from an external device such as the personal computer 22 or in a case where the inkjet recording apparatus 1 performs the print operation based on image data stored in a nonvolatile storage medium. As mentioned above, in the present embodiment, the print duty ratio in a case where the temperature generated in the inkjet head 3 through the print operation by the inkjet recording apparatus 1 is high has a higher value than that in a case where the temperature generated in the inkjet head 3 is low. Further, as another example, the print duty ratio can be considered to be a ratio of a period of time (an actual actuator drive period) in which the drive signal is supplied to the piezoelectric actuator 12 in order that ink is ejected from the inkjet head 3 with respect to the print operation period. As mentioned above, in the present embodiment, the print duty ratio in the case where the temperature generated in the driver IC 14 through the print operation by the inkjet recording apparatus 1 is high has a higher value than that in the case where the temperature in the driver IC 14 is low.

Figure 5A:
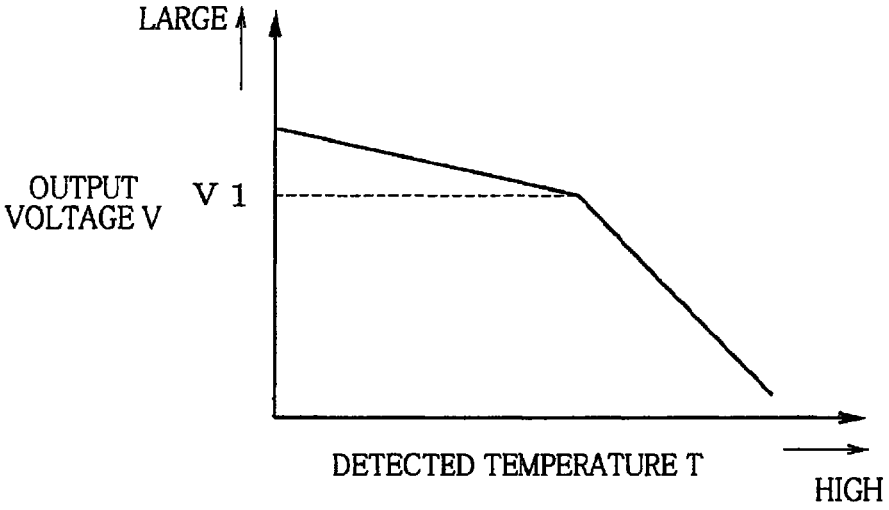
FIG. 5A is a view showing a relation between a temperature and an output voltage in a first print mode.
Figure 5B:
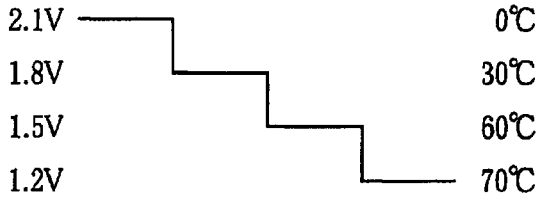
FIG. 5B is an illustrative view showing a detection sensitivity within a low temperature range in the first print mode.
Figure 5C:
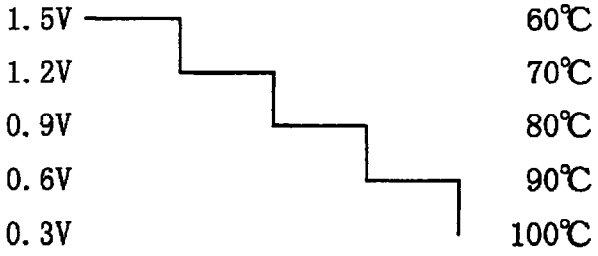
FIG. 5C is an illustrative view showing a detection sensitivity within a high temperature range in the first print mode.

In the case of the first print mode with the high print duty ratio, an amount of ink ejection is large, so that it is possible that a temperature in the inkjet head 3 is relatively high and the inkjet head 3 is frequently used within a high temperature range (in the present embodiment, a range of 60° C. to 100° C.). Therefore, in the first print mode, as shown in FIG. 5A, while, in the high temperature range, detection sensitivity substantially equivalent to the conventional example (the prior art) is secured by changing the current value of the supply current based on the output voltage (predetermined temperature) depending on the detected temperature, in a low temperature range, the detection sensitivity keeps low. As described related to the prior art, for example, in a case where a temperature range of 0° C. to 100° C. is detected within a range of the output voltage of 2.1 V to 0 V that can be used and an interval of the output voltage is determined to be 0.3 V, in the high temperature range, an inclination (a percentage of an amount of change in output voltage with respect to an amount of change in temperature) keeps large such that 6 points at intervals of 10° C. can be detected (shown in FIG. 5C) similar to the conventional example. On the other hand, in the low temperature range (in the present embodiment, a range of 0° C. to 60° C.), the inclination is made small (i.e., an increase of the output voltage is made smaller as the output voltage approaches 2.1 V) such that 2 points at intervals of 30° C. can be detected (shown in FIG. 5B). Accordingly, the detection sensitivity in the low temperature range is lower than that in the high temperature range.

Figure 6A:
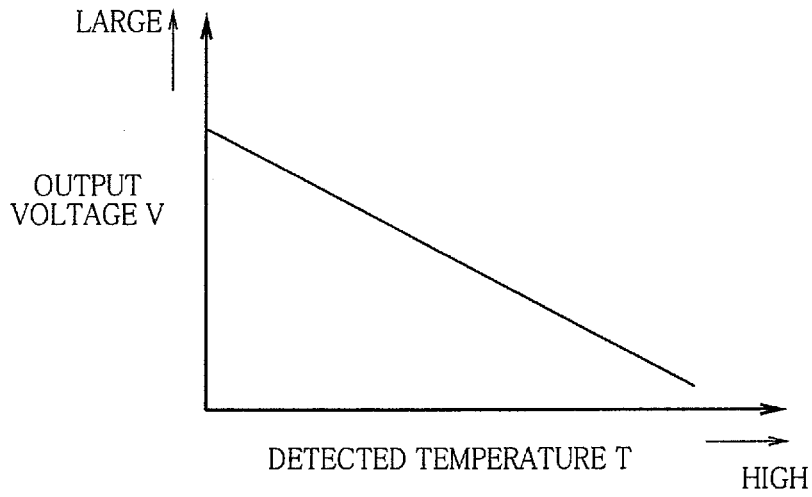
FIG. 6A is a view showing a relation between a temperature and an output voltage in a second print mode and FIG. 6B is an illustrative view showing a detection sensitivity in the second print mode.
Figure 6B:
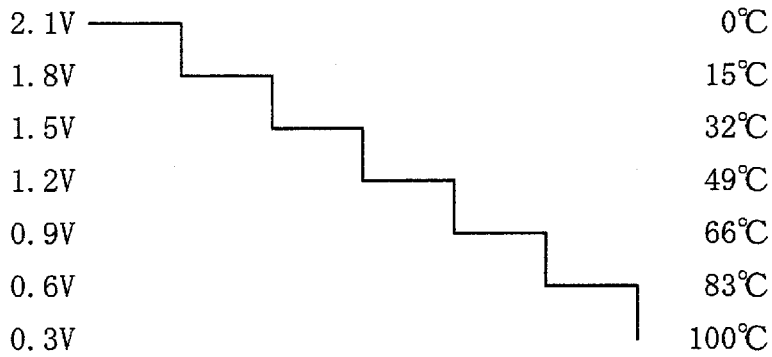

In the case of the second print mode with the low print duty ratio, an amount of ink ejection is small, so that it is possible that the temperature of the inkjet head 3 does not sharply increase and the inkjet head 3 is mainly used within the low temperature range. Therefore, in the second print mode, the current value of the supply current from the power source 23 is made small and, as shown in FIG. 6A, the inclination is larger than that in the first print mode with the high print duty ratio such that, while in the low temperature range the detection sensitivity is secured, in the high temperature range the detection sensitivity is lowered compared to the first print mode with the high print duty ratio. Similarly as mentioned before, for example, in the case where the temperature range of 0° C. to 100° C. is detected within the range of the output voltage of 2.1 V to 0 V that can be used and the interval of the output voltage is determined to be 0.3 V, 7 points as a whole can be detected at substantially equal intervals of temperature both in the low temperature range and in the high temperature range (shown in FIG. 6B). Accordingly, the current value of the supply current from the power source 23 changes such that the detection sensitivity in the low temperature range is increased, compared to the case of the first print mode with the high print duty ratio as shown in FIGS. 5A thorough 5C.

Thus, desirable detection sensitivity can be obtained in a temperature range which is necessary to be detected and is changeable depending on a detection object and a purpose of use (print modes). In other words, the current value of the supply current from the power source 23 changes in consideration of the temperature range of the inkjet head 3 different depending on the print modes, so that the detection sensitivity can be properly adopted depending on the print modes.

The determination output means 21D outputs a change instructing signal based on the output voltage V outputted from the temperature detecting portion 14B. In other words, the output voltage V inputted from the temperature detecting portion 14B is compared with the predetermined reference voltage V1 (the reference-voltage generating portion 21D*c*), and in the case where the output voltage V is equal to or greater than the reference voltage V1, the change instructing signal is outputted to the current-value change means 21C in order to change the detection sensitivity of the temperature detecting portion 14B.

When the current-value change means 21C receives the change instructing signal from the determination output means 21D, the current-value change means 21C changes the current value of the supply current to be supplied to the temperature detecting portion 14B.

The diode 14Bb is an example of the element in the present invention.

Hereinafter, control for determining the supply current of the temperature detecting portion 14 by the above-mentioned control means 21 will be described with reference to FIGS. 7 and 8.

Figure 7:
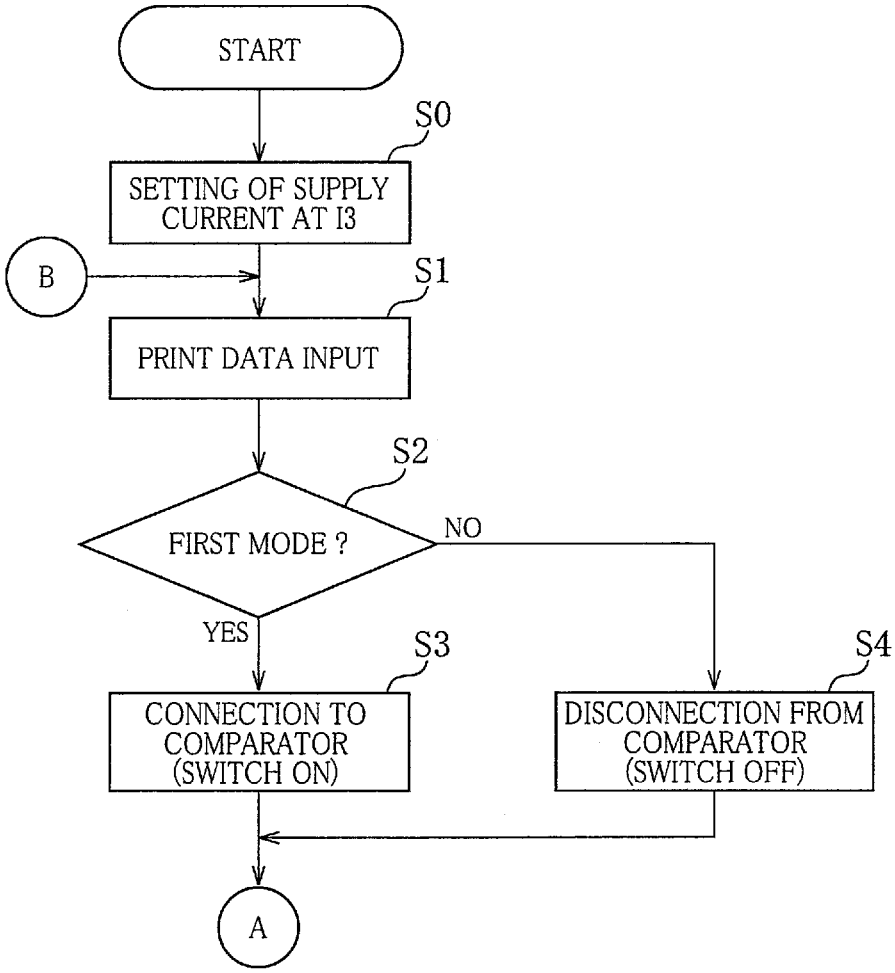
FIG. 7 is a flow chart illustrating a flow of control in a control means.

As shown in FIG. 7, the control starts when the power source of the inkjet recording apparatus 1 is on, and a value of the supply current to be supplied to the temperature detecting portion 14 is set at a current value I3 as an initial value (step S0). The current value of the supply current to the temperature detecting portion 14 is kept the current value I3 until the print data are inputted to the control means 21. The current value I3 is smaller than a current value I1 and a current value I2 that will be described later. After that, when the print data are inputted from the personal computer 22 (step S1), it is determined whether the print duty ratio X in this print mode is the first print mode (e.g., the photo print mode), in which the print duty ratio is equal to or greater than the predetermined value A, or the second print mode (e.g., the draft mode), in which the print duty ratio is below the predetermined value A (step S2).

In the case of the first print mode, it is possible that the temperature of the inkjet head 3 becomes high, so that, in order to control the print operation by the temperature detection based on a relation between the temperature and the output voltage shown in FIG. 5A, the connection switch 21D*a* is on so as to connect the temperature detecting portion 14B to the comparator 21D*b* (step S3). On the other hand, in the case of the second print mode, it is possible that the temperature of the inkjet head 3 does not become much high, so that, in order to control the print operation by the temperature detection based on a relation between the temperature and the output voltage shown in FIG. 6A, the connection switch 21D*a* is off so as to disconnect the temperature detecting portion 14B from the comparator 21D*b* (step S4). In other words, in the case of the first print mode, the connection switch 21D*a* of the determination output means 21D is turned on such that signals from the temperature detecting portion 14B is inputted to the comparator 21D*b*. Thus, in the comparator 21D*b*, the output voltage V is compared with the reference voltage V1, and in the case where the output voltage V is equal to or greater than the reference voltage V1, the change instructing signal is outputted from the comparator 21D*b*. In the case of the second print mode, the connection switch 21D*a* of the determination output means 21D is turned off, so that the output voltage V from the temperature detecting portion 14B is not compared with the reference voltage V1 and the change instructing signal is not outputted from the comparator 21D*b*.

Figure 8:
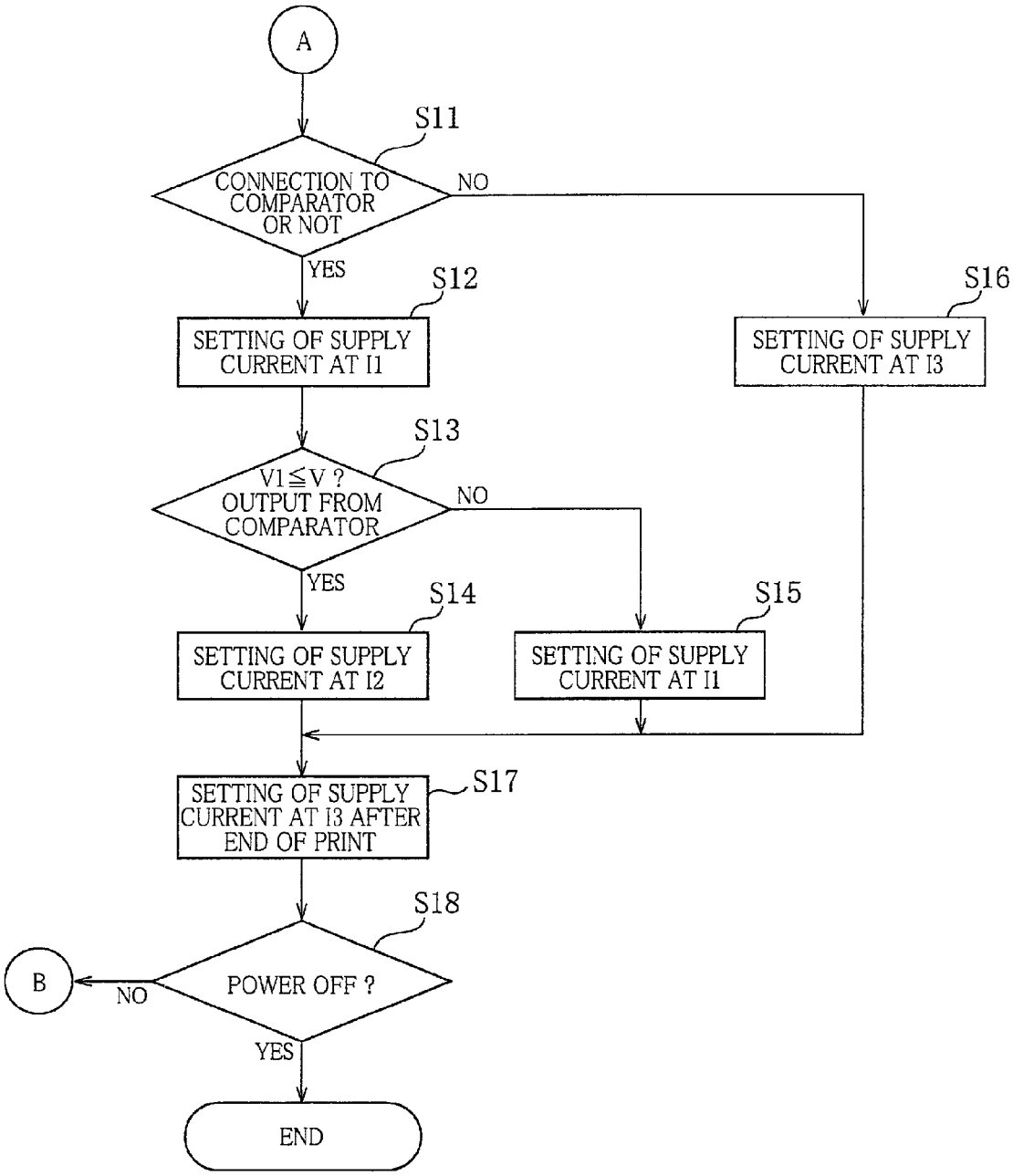
FIG. 8 is a flow chart illustrating another flow of control in the control means.

Then, when the print starts, as shown in FIG. 8, it is determined whether the temperature detecting portion 14B is connected to the comparator 21D*b* of the determination output means 21D (step S11), and in a case where the temperature detecting portion 14B is connected to the comparator 21D*b*, in the first print mode, the temperature is detected based on FIG. 5A, so that, assuming that the current value of the supply current from the power source 23 is within the high temperature range (e.g., the range of 60° C. to 100° C.), the supply current is first set at the current value I1 by the current-value change means 21C, and the first current value I1 is outputted from the power source 23 (step S12).

Then, in the comparator 21D*b*, the output voltage V from the temperature detecting portion 14B is compared with the reference voltage V1 (step S13), in the case where the output voltage V is equal to or greater than the reference voltage V1, because it is considered that the control is performed within the low temperature range (e.g., the range of 0° C. to 60° C.), the current value of the supply current from the power source 23 is set at the second current value I2 smaller than the first current value I1, and the second current value I2 is outputted from the power source 23 (step S14). On the other hand, in the case where the output voltage V is less than the reference value V1, considering that the control is performed within the high temperature range (e.g., the range of 60° C. to 100° C.), the current value of the supply current from the power source 23 is kept the first current value I1, and the first current value I1 is outputted from the power source (step S15). In the present embodiment, the temperature corresponding to the reference voltage V1 is, for example, 60° C.

In a case where it is determined in step S11 that the temperature detecting portion 14B is not connected to the comparator 21D*b*, in the second print mode, the temperature is detected based on FIG. 6A, so that the current value of the supply current from the power source 23 is set at the third current value I3 smaller than the first and the second current values I1, I2, and the third current value I3 is outputted from the power source 23 (step S16). After that, during the print operation, the current values set in respective steps S14, S15, S16 is supplied from the power source 23 to the temperature detecting portion 14B. After the print operation is finished, the current value to be supplied from the power source 23 to the temperature detecting portion 14B is changed to the current value I3 and is outputted to the temperature detecting portion 14B (step S17). In a case where the power source of the inkjet recording apparatus 1 is turned off, the control shown in FIGS. 7 and 8 is finished (step S18: YES), and in a case where the power source of the inkjet recording apparatus 1 is not turned off, the current value of the supply current is kept the current value I3 until next input of the print data (step S18: NO).

As mentioned above, in the inkjet recording apparatus 1 to which the present invention is applied, when the determination output means 21D outputs the change instructing signal based on the output voltage outputted from the temperature detecting portion 14B, the current value of the current to be supplied to the diodes 14B*b* of the temperature detecting portion 14B is changed by the current-value change means 21C, so that the voltage value of the output voltage from the temperature detecting portion 14B changes depending on the change in the current value.

Accordingly, since the relation between the detected temperature and the output voltage of the temperature detecting portion 14B is changed, the amount of change in the output voltage with respect to the amount of change in the detected temperature is changed. Therefore, the detection sensitivity, a ratio of the amount of change in the output voltage with respect to the amount of change in the temperature, can be adjusted depending on the detected object or the intended purpose.

Further, the detection sensitivity of the temperature detection in the range of temperature used in each print mode can be most suitable depending on each print mode. Thus, in a print mode with a low print duty ratio, the current value of the current from the power source 23 is made small and the amount of change in output voltage with respect to the amount of change in temperature in the low temperature range is made large, so that the detection sensitivity in the low temperature range can be increased.

Furthermore, in a print mode with a high print duty ratio, the current value of the current supplied from the power source 23 is made large and the amount of change in output voltage with respect to the amount of change in temperature in the high temperature range is made large, so that the detection sensitivity in the high temperature range can be increased.

The present invention is not limited to the illustrated embodiment, and the present invention may be embodied with changes and modifications as follows.

First Modified Example

In the illustrated embodiment, the reference voltage generation portion 21D*c* generates the reference voltage V1 and the reference voltage of the comparator 21D*b* is set at a constant value. However, the reference value may be changeable.

In the first modified example, because the reference voltage is changed, the detection sensitivity can be changed based on the temperature detected by the temperature sensor.

Second Modified Example

Figure 9:
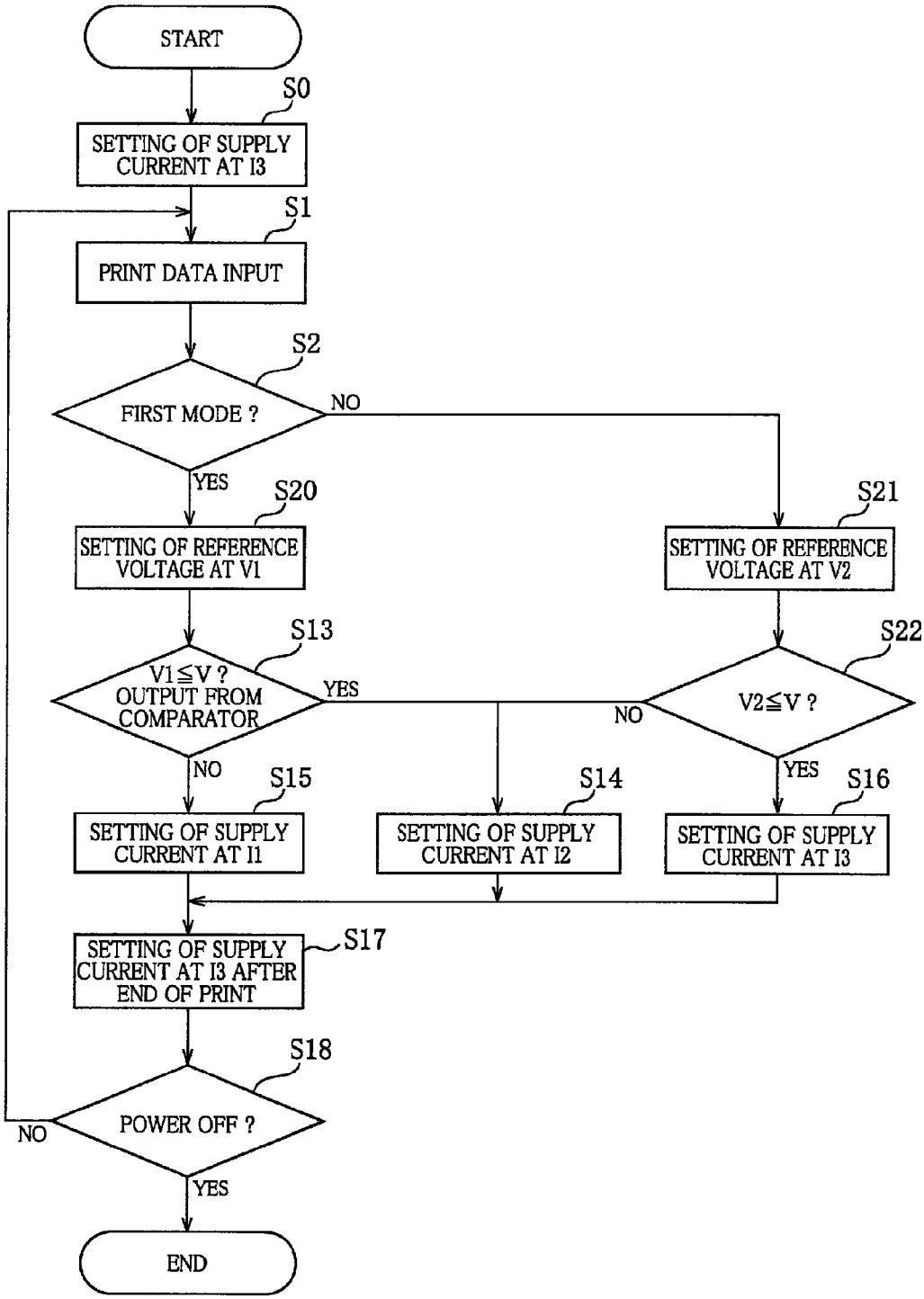
FIG. 9 is a flow chart illustrating a flow of control in a control means of an inkjet recording apparatus as a second modified example.

In the illustrated embodiment, the determination output means 21D outputs the change instructing signal to the current-value change means 21C based on the output voltage of the temperature detecting portion 14B (the temperature sensor). In addition to the case where the determination output means 21D outputs the change instructing signal based on the output voltage of the temperature detecting portion 14B, the current-value change means 21C may change the current value of the supply current to be supplied to the temperature detecting portion 14B when having received the mode change signal outputted from the mode switch means 21B. The second modified example will be described with reference to FIG. 9. FIG. 9 is a view showing a flow chart representing a control corresponding to FIGS. 7 and 8 in the illustrated embodiment. When the power source of the inkjet recording apparatus 1 is turned on, the control starts. It is determined whether the print mode is the first mode (step S2), and in a case where the print mode is the first mode, the reference voltage is set at the voltage value V1 (step S20), and in a case where the print mode is not the first mode, the reference voltage is set at a voltage value V2 (V2 is greater in voltage value than V1) (step S21). After that, in step S13, in a case where the output voltage V from the temperature detecting portion 14B is less than the reference value V1 (step S13: NO), the supply current of the temperature detecting portion 14B is set at a current value I1, and in a case where the output voltage V is equal to or greater than the reference voltage V1, the supply current of the temperature detecting portion 14B is set at a current value I2. Further, in step S22, in a case where the output voltage V from the temperature detecting portion 14B is less than the reference voltage V2 (step S22: NO), the supply current of the temperature detecting portion 14 is set at the current value I2 (step S14), and in a case where the output voltage V is equal to or greater than the reference voltage V2

(step S22: YES), the supply current of the temperature detecting portion 14B is set at the current value I3 (step S16). In the second modified example, the mode switch means 21B is directly connected to the determination output means 21D, and the determination output means 21D changes the reference voltage when having received the mode change signal outputted from the mode switch means 21B. In the second modified example, since the reference voltage V1 of the comparator 21D*b* can be an appropriate value depending on whether the print mode is the first mode, so that the detection sensitivity of the temperature detection within the range of temperature used in each print mode can be most suitable depending on each print mode.

Third Modified Example

Figure 10:
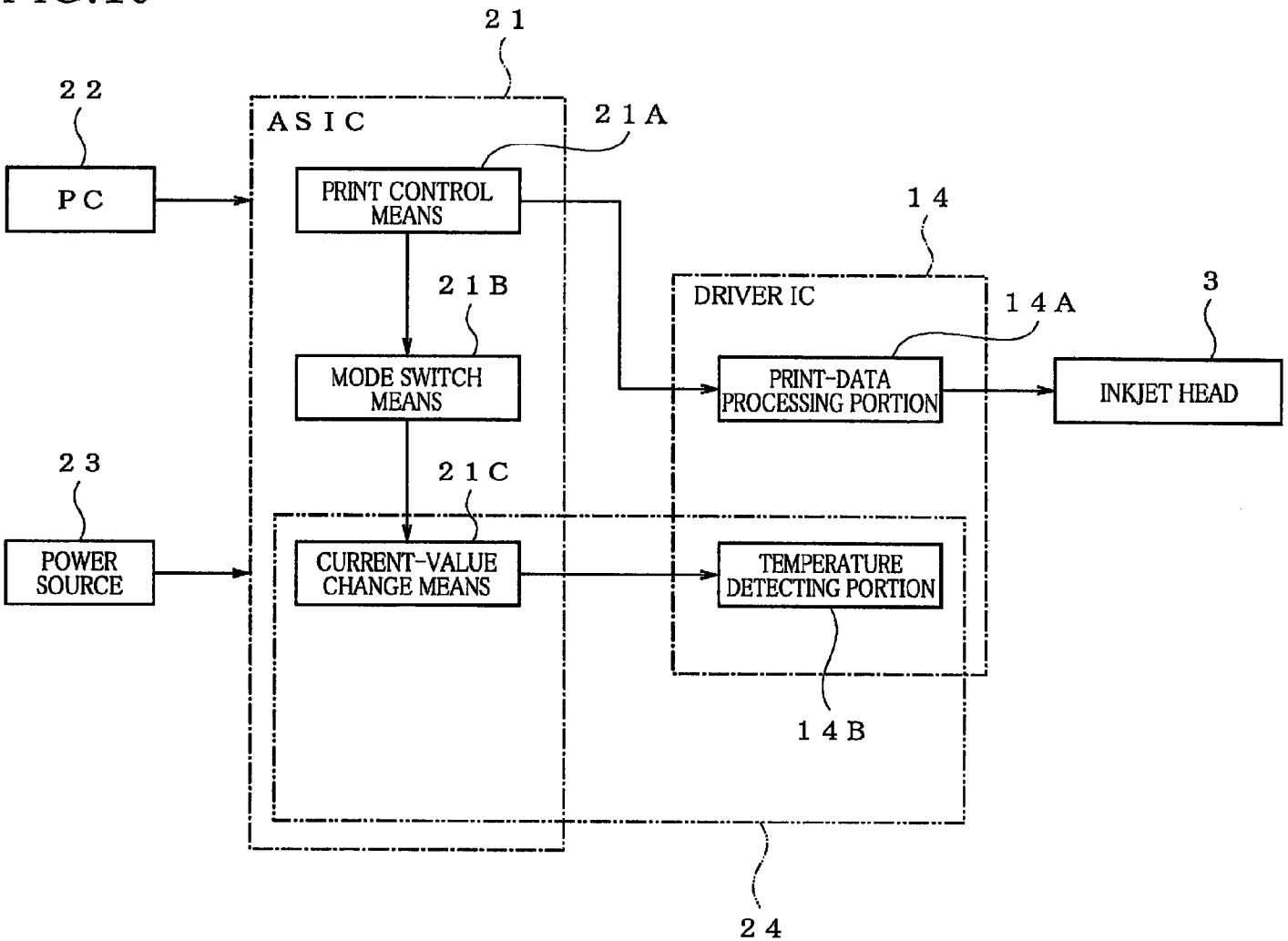
FIG. 10 is a block diagram showing a control system of an inkjet recording apparatus as a third modified example.
Figure 11:
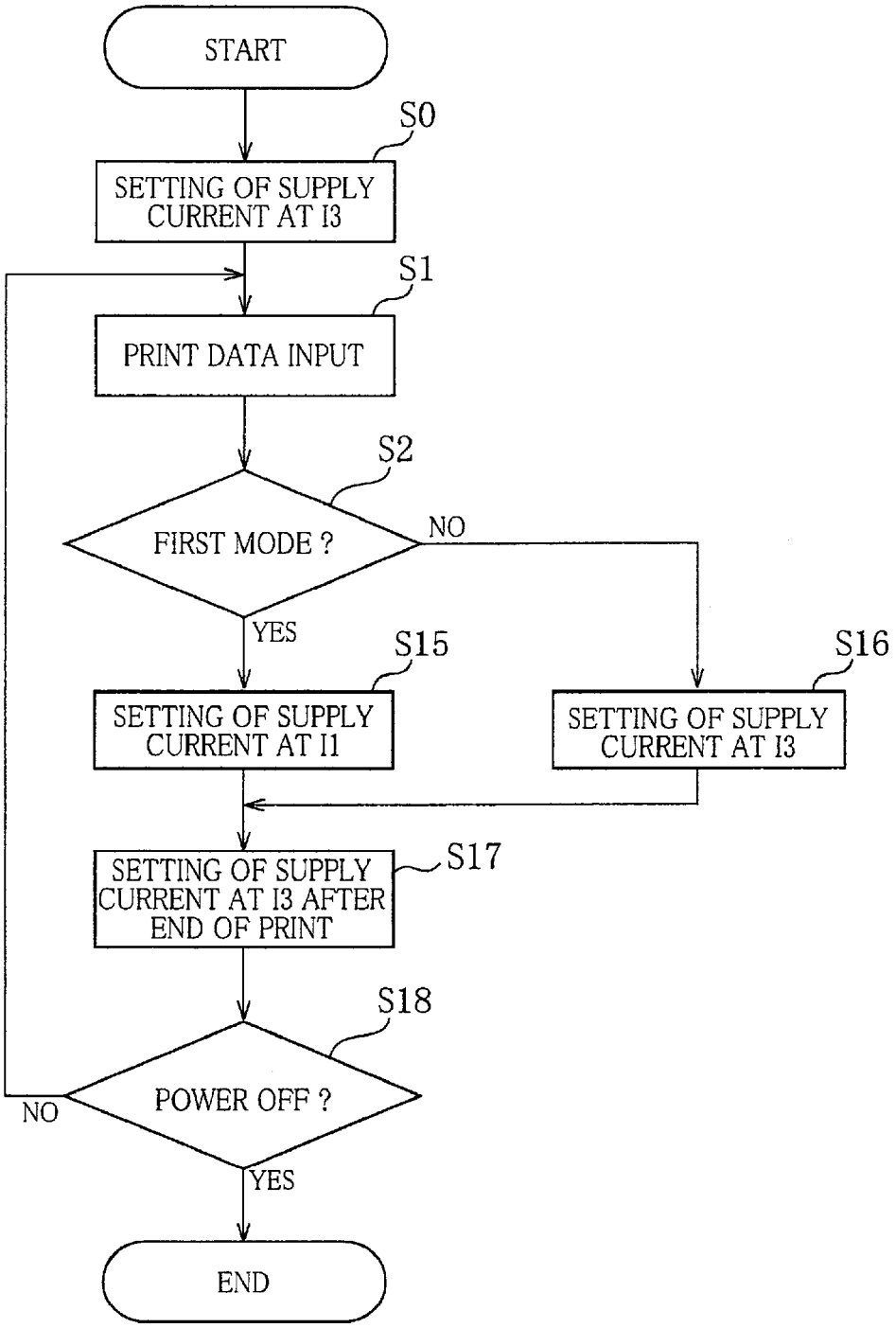
FIG. 11 is a flow chart showing a flow of control in a control means in the third modified example.

Regardless of the determination output means 21D or without the determination output means 21D, the current-value change means 21C may change the current value of the supply current to be supplied to the temperature detecting portion 14B (the temperature sensor) when having received the mode change signal outputted from the mode switch means 21B. The third modified example will be described with reference to FIGS. 10 and 11. FIG. 10 corresponds to FIG. 3 in the illustrated embodiment and the determination output means 21D is omitted from FIG. 3. FIG. 11 shows a flow chart representing a control corresponding to FIGS. 7 and 8 in the illustrated embodiment. The control starts when the power source of the inkjet recording apparatus 1 is turned on. In the control in FIG. 11, processes (steps) in which the output voltage V of the temperature detecting portion 14B is compared with the respective reference voltages V1, V2 in the control in FIG. 9 are omitted. In the third modified example, since the supply current of the temperature detecting portion 14B is set depending on whether the print mode is the first mode, the determination output means 21D can be omitted, so that the structure of the control means 21 can be simplified and the cost of the control means 21 can be reduced.

Fourth Modified Example

Figure 12:
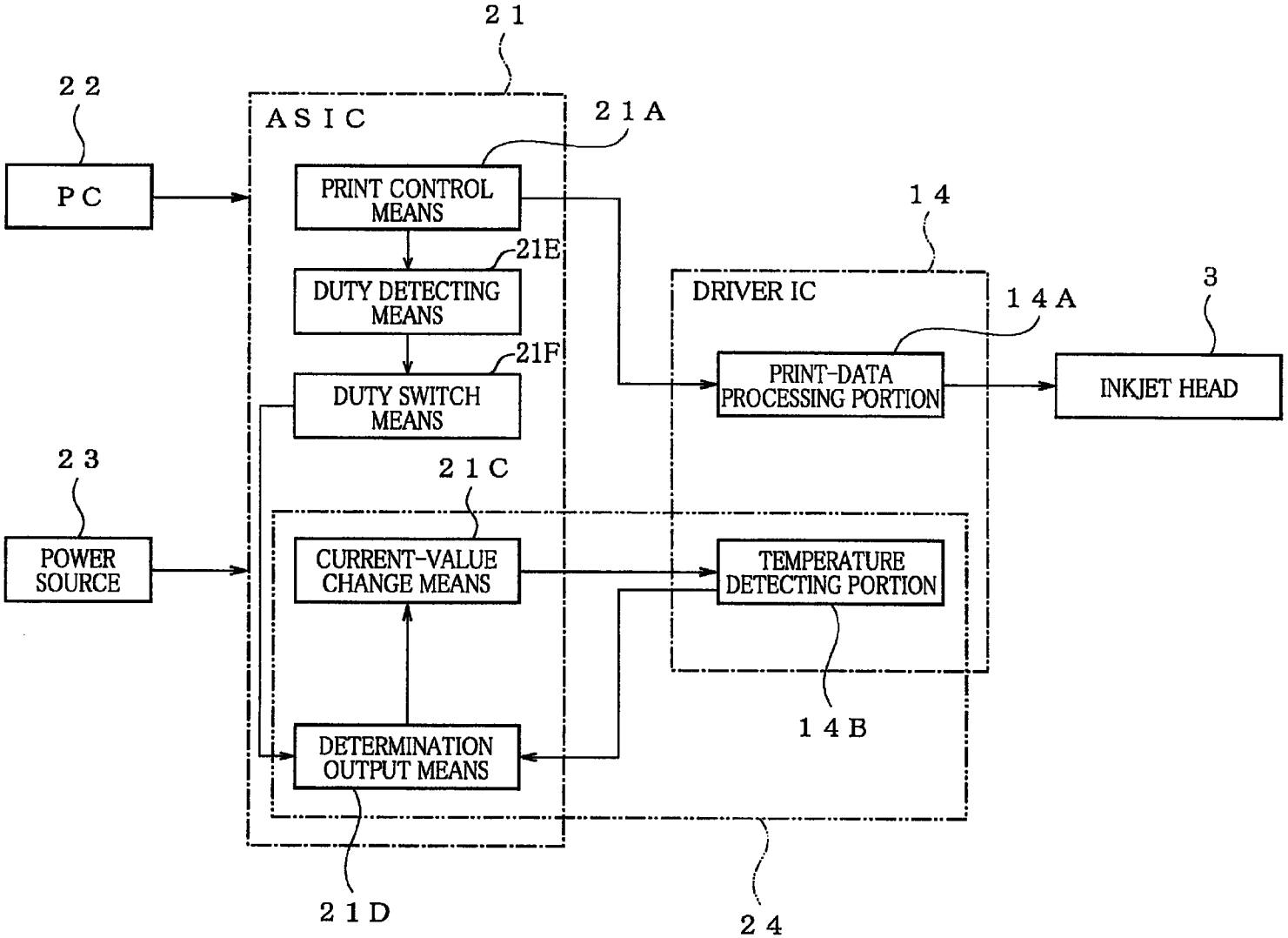
FIG. 12 is a block diagram showing a control system of an inkjet recording apparatus as a fourth modified example.
Figure 13:
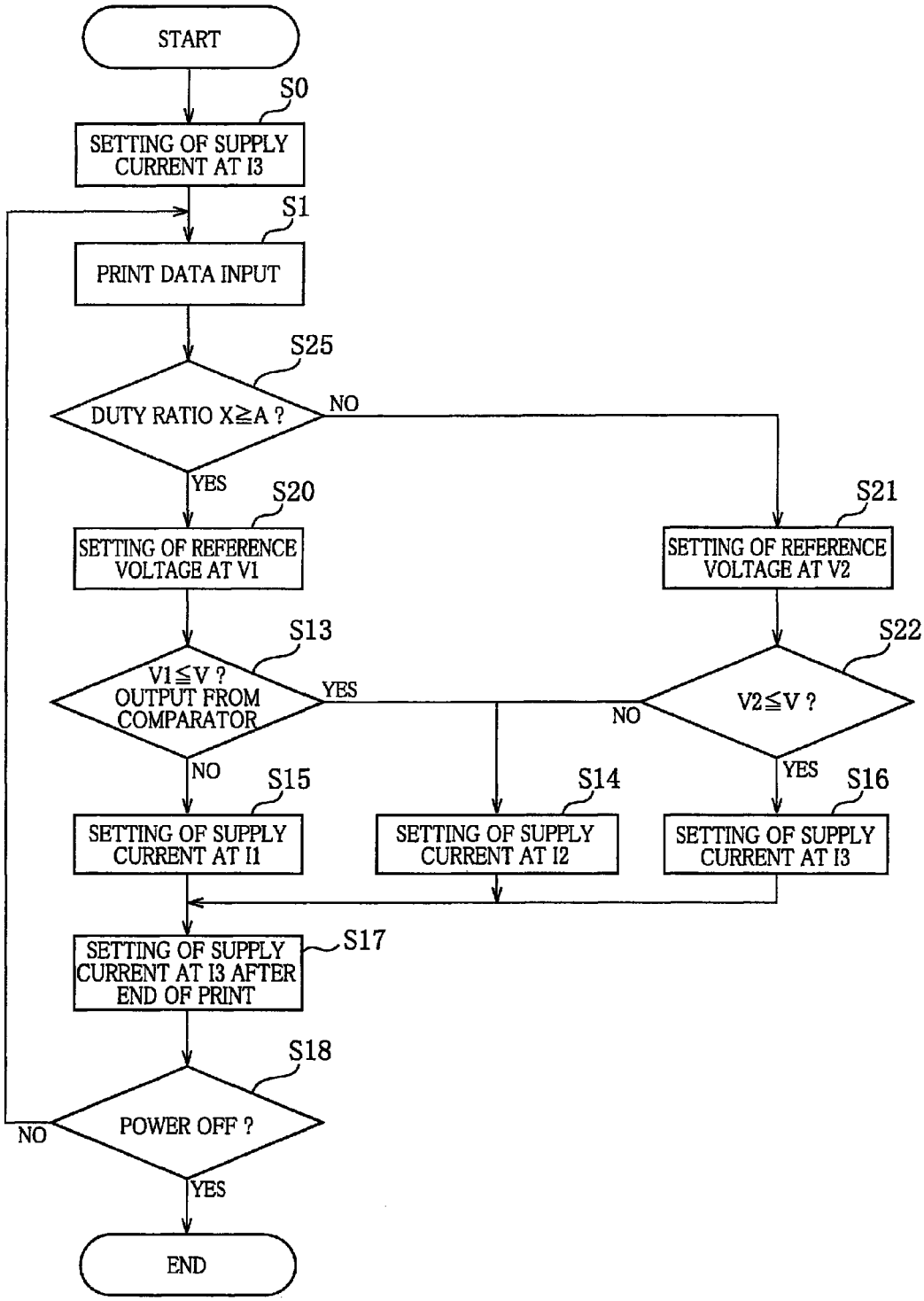
FIG. 13 is a flow chart showing a flow of control in a control means in the fourth modified example.

In the illustrated embodiment, the determination output means 21D outputs the change instructing signal to the current-value change means 21C based on the output voltage of the temperature detecting portion 14B (the temperature sensor). However, in a case of an inkjet recording apparatus including a duty detecting means 21E (shown in FIG. 12) which detects the print duty ratio and a duty switch means 21F (shown in FIG. 12) which outputs a duty change signal to the current-value change means 21C based on the duty detecting means 21E, in addition to the case where the current-value change means 21C outputs the change instructing signal based on the output voltage of the temperature detecting portion 14B, the current-value change means 21C may change the current value of the supply current to be supplied to the temperature detecting portion 14B when having received the duty-change-signal outputted from the duty switch means 21F. The fourth modified example will be described with reference to FIGS. 12 and 13. FIG. 12 corresponds to FIG. 3 in the illustrated embodiment and FIG. 13 corresponds to FIGS. 7 and 8 in the illustrated embodiment. In the fourth modified example, the duty switch means 21F is directly connected to the determination output means 21D, and the determination output means 21D changes the reference voltage of the comparator 21D*b* of the determination output means 21D when having received the duty-change-signal outputted from the duty switch means 21F. As shown in FIG. 13, in step S25, the duty detecting means 21E detects the print duty ratio based on the print data, and depending on whether the detected print duty ratio X is equal to or greater than a predetermined value A, the reference voltage of the comparator 21D*b* is set at either one of the reference values V1, V2.

In the fourth modified example, when a change of the print duty ratio is detected, the duty change signal is outputted by the duty switch means 21F, so that the detection sensitivity can be switched depending on the change of the print duty ratio.

Fifth Modified Example

Figure 14:
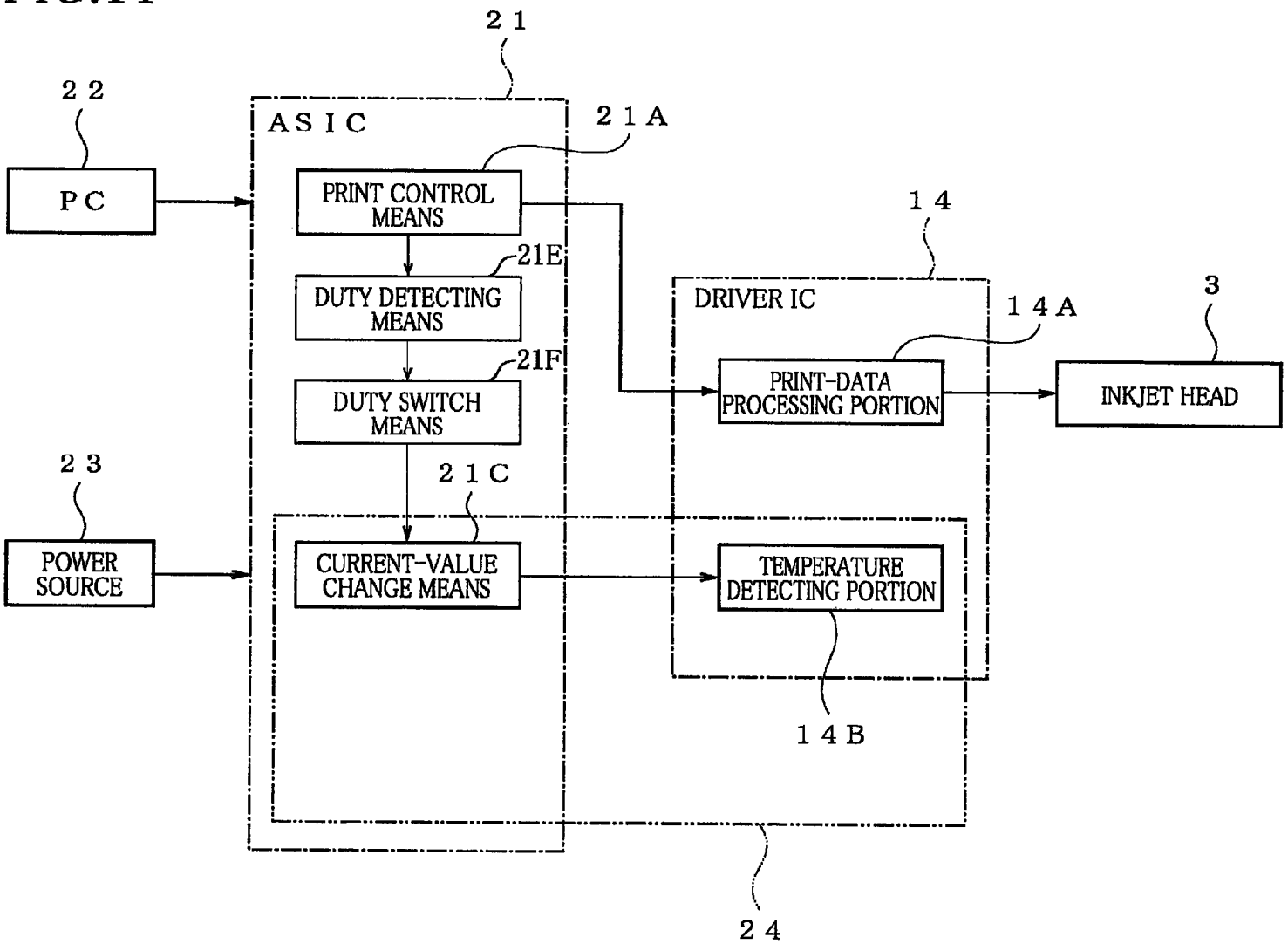
FIG. 14 is a block diagram showing a control system of an inkjet recording apparatus as a fifth modified example.
Figure 15:
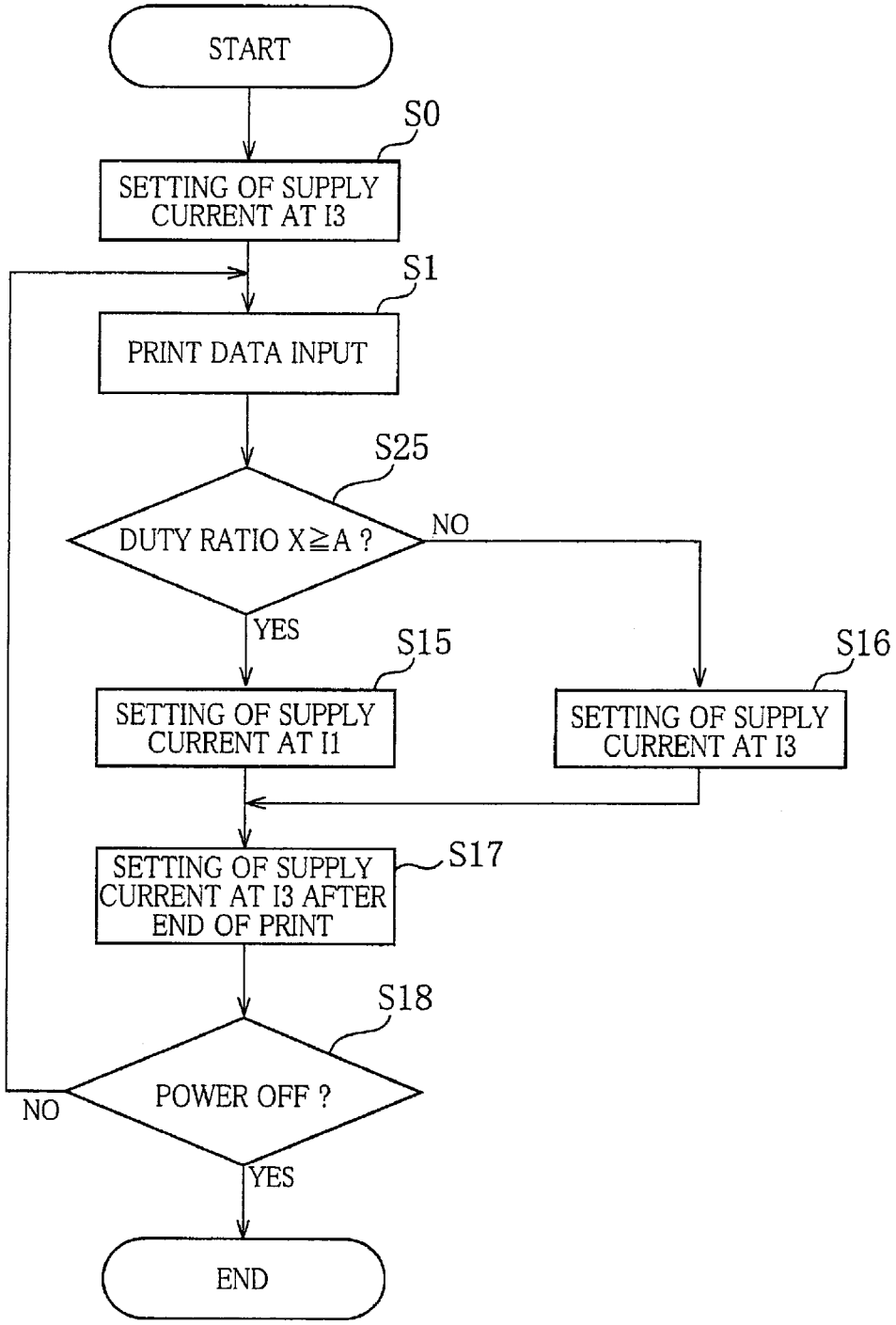
FIG. 15 is a flow chart showing a flow of control in a control means in the fifth modified example.
Figure 16A:
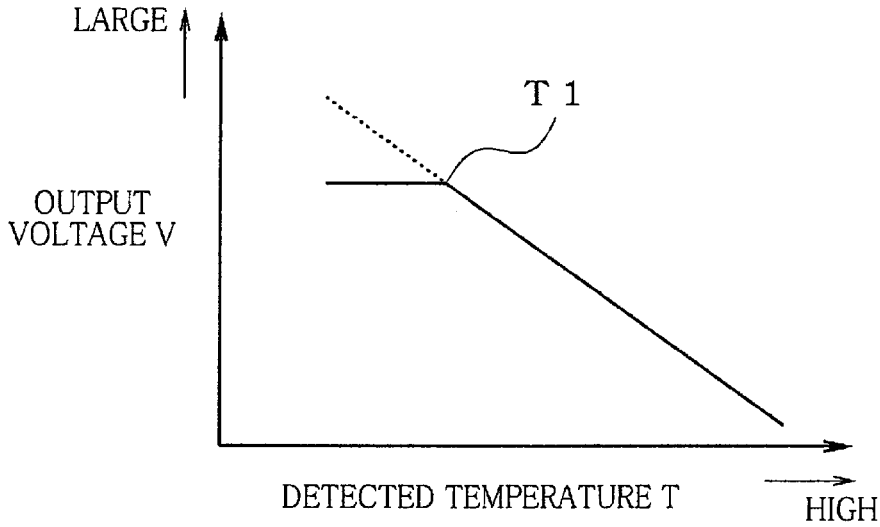
FIG.16A PRIOR ART
FIG. 16A is a views showing a relation between a detection temperature and an output voltage of a temperature sensor in the prior art and FIG. 16B is a view similar to FIG. 16A in a case of the output voltage of the temperature sensor through analog/digital conversion.
Figure 16B:
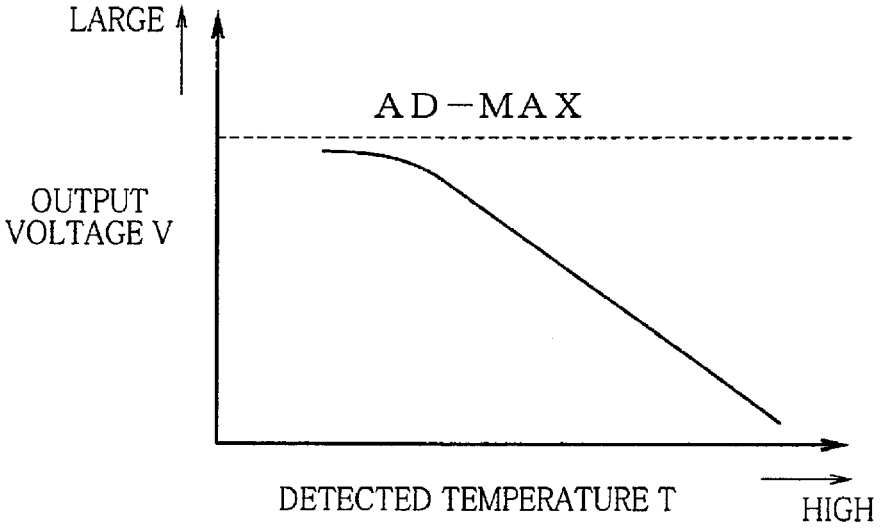
FIG.16B PRIOR ART

Regardless of the determination output means 21D or without the determination output means 21D, the current-value change means 21C may change the current value of the supply current to be supplied to the temperature detecting portion 14B (the temperature sensor) when having received the duty-change-signal outputted from the duty switch means 21F. The fifth modified example will be described with reference to FIGS. 14 and 15. FIG. 14 corresponds to FIG. 12 in the fourth modified example and is equivalent to that the determination output means 21D in FIG. 12 is omitted. FIG. 15 also corresponds to FIG. 13 in the fourth modified example and is equivalent to that steps S13, S14, S21 and S22 in FIG. 13 are omitted. In the fifth modified example, since the supply current of the temperature detecting portion 14B can be set at the current value I1 or the current value I3 depending on whether the print duty ratio is equal to or greater than the predetermined value A, the determination output means 21D is omitted, so that the structure of the control means 21 can be simplified and the cost of the control means 21 can be reduced.

Sixth Modified Example

It is possible that, in a case where the print mode with the low print duty ratio is set and the same print mode is maintained, every time when the carriage 2 scans once on the print sheet P, the print duty ratio of the scan is detected and the current value of the current to be supplied to the element is changed based on the result of detection such that the detection sensitivity can be switched each scan of the carriage 2. In the sixth modified example, the change in the print duty ratio is detected and the current value of the supply current from the power source 23 is made small such that the amount of change in output voltage with respect to the amount of change in temperature in the low temperature range is increased, so that, in the case of the print mode with the low print duty ratio, the detection sensitivity in the high temperature range can be reduced and the detection sensitivity in the low temperature range can be increased.

Seventh Modified Example

The current value of the supply current from the power source 23 is made large such that the amount of change in output voltage with respect to the amount of change in temperature in the low temperature range is decreased, so that, in the case of the print mode with the high print duty ratio, the detection sensitivity necessary in the high temperature range can be obtained.

Eighth Modified Example

In the illustrated embodiment, in the change in the current value by the current-value change means 21C, two kinds of the current values are used. Instead of this, more than two kinds of current values may be used, and more detailed temperature detection can be performed by a proper change in those current values. Further, three or more kinds of reference voltages may be used, and more detailed temperature detection can be performed by a proper change in those reference voltages.

In the illustrated embodiment, the embodiment in which the present invention is applied to the inkjet recording apparatus 1 was described, however, the present invention is not limited to an inkjet recording apparatus. For example, the present invention is applicable to any electric device having a driver IC.

What is claimed is:

1. A temperature detecting apparatus, which is used for an inkjet recording apparatus, comprising:

a temperature sensor having an element whose resistance value changes depending on temperature and configured to detect temperature based on a voltage value obtained by supply of a supply current to the element from a power source;

a print-duty-ratio detecting portion configured to detect a print duty ratio of recording executed by the inkjet recording apparatus, the print duty ratio being detected on the basis of print data; and a current-value change portion disposed between the power source and the element, the current-value change portion configured to change a current value of the supply current to be supplied to the element in accordance with the print duty ratio detected by the print-duty detecting portion.

2. The temperature detecting apparatus according to claim 1, further comprising:

a voltage-value detecting portion configured to detect an output voltage of the temperature sensor, wherein the current-value change portion is configured to change the current value of the supply current in accordance with the print duty ratio and the output voltage of the temperature sensor detected by the voltage-value detecting portion.

3. The temperature detecting apparatus according to claim 1, wherein the current-value change portion is configured to set the current value of the supply current to a first current value, when the print duty ratio detected by the print-duty-ratio detecting portion is a first print duty ratio, and wherein the current-value change portion is configured to set the current value of the supply current to a second current value, when the print duty ratio detected by the print-duty-ratio detecting portion is a second print duty ratio which is less than the first print duty ratio value, and the second current value is less than the first current value.

4. The temperature detecting apparatus according to claim 1, wherein the temperature sensor is configured to output an output voltage depending on the voltage value, the temperature detecting apparatus further comprising:

a change-instructing-signal output portion connected to the temperature sensor and configured to output a change instructing signal for changing the supply current based on the output voltage outputted from the temperature sensor, wherein the current-value change portion is configured to change the current value of the supply current, when the current-value change portion has received the change instructing signal from the change-instructing-signal output portion.

5. The temperature detecting apparatus according to claim 4, wherein the change-instructing-signal output portion includes a comparator configured to compare the inputted output voltage with a changeable reference voltage.

6. The temperature detecting apparatus according to claim 1, further comprising:

a mode switch portion configured to switch one print mode to another print mode whose print duty ratio is different from that of the one print mode, wherein the mode switch portion is configured to output a mode switch signal to the current-value change portion in a case where the print mode has been switched, and wherein the current-value change portion is configured to change the current value of the supply current to be supplied to the element, when the current-value change portion has received the mode switch signal outputted from the mode switch portion.

7. The temperature detecting apparatus according to claim 1, further comprising:

a duty-change-signal output portion configured to output a duty change signal to the current-value change portion, wherein the current-value change portion is configured to change the current value, when the current-value change portion has received the duty-change-signal outputted from the duty-change-signal output portion.

8. The temperature detecting apparatus according to claim 5, further comprising a mode switch portion configured to one print mode to another print mode whose print duty ratio is different from that of the one print mode, wherein the mode switch portion is configured to output a mode switch signal to the change-instructing-signal output portion in a case where the print mode has been switched, and wherein the change-instructing-signal output portion is configured to change the reference voltage of the comparator when having received the mode switch signal outputted from the mode switch portion.

9. A temperature detecting apparatus, which is used for an inkjet recording apparatus, comprising:

a mode switch portion configured to switch one print mode to another print mode whose print duty ratio is different from that of the one print mode, the print mode being switched based on the print duty ratio detected on the basis of the print data, a temperature sensor having an element whose resistance value changes depending on temperature and configured to detect temperature based on a voltage value obtained by supply of a supply current to the element from a power source; and a current-value change portion disposed between the power source and the element, the current-value change portion configured to change a current value of the supply current to be supplied to the element, wherein the mode switch portion is configured to output a mode switch signal to the current-value change portion, when the print mode is switched, and wherein the current-value change portion is configured to change the current value of the supply current to be supplied to the element, when the current-value change portion has received the mode switch signal from the mode switch portion.

10. A temperature detecting apparatus, which is used for an inkjet recording apparatus, comprising:

a print-duty-ratio detecting portion configured to detect a print duty ratio of recording executed by the inkjet recording apparatus, the print duty ratio being detected on the basis of print data;

a duty-change-signal output portion configured to output a duty change signal based on a detection result by the print-duty-ratio detecting portion;

a temperature sensor having an element whose resistance value changes depending on temperature and configured to detect temperature based on a voltage value obtained by supply of a supply current to the element from a power source; and a current-value change portion disposed between the power source and the element, the current-value change portion configured to change a current value of the supply current to be supplied to the element, wherein the current-value change portion is configured to change the current value of the supply current to be supplied to the element, when the current-value change portion has received the duty change signal.

* * * * *